US006293478B1

(12) United States Patent
Livrieri

(10) Patent No.: US 6,293,478 B1
(45) Date of Patent: Sep. 25, 2001

(54) MILLING DEVICE WITH DOUBLE MILLING PASSAGE, APPARATUS USING THE DEVICE, AND METHOD USING THE DEVICE

(75) Inventor: Filippo Livrieri, Cremona (IT)

(73) Assignee: Ocrim S.p.A., Cremona (IT)

( * ) Notice: Subject to any disclaimer, the term of this patent is extended or adjusted under 35 U.S.C. 154(b) by 0 days.

(21) Appl. No.: 09/285,769

(22) Filed: Apr. 5, 1999

(30) Foreign Application Priority Data

Apr. 7, 1998 (IT) ..... MI98A0742

(51) Int. Cl.[7] ..... B02C 9/04

(52) U.S. Cl. ..... 241/78; 241/11; 241/13; 241/29; 241/159

(58) Field of Search ..... 241/159, 78, 29, 241/11, 13

(56) References Cited

U.S. PATENT DOCUMENTS 744,567 * 11/1903 Krusemark ..... 241/78
1,218,634 * 3/1917 Dodds ..... 241/78
3,868,063 * 2/1975 Slaker ..... 241/101.7
4,089,777 5/1978 Macaulay et al. ..... 209/259
4,592,516 * 6/1986 Tschantz ..... 241/76
5,100,062 * 3/1992 Baltensperger et al. ..... 241/9

FOREIGN PATENT DOCUMENTS 3327 8/1877 (DE) .
207543 3/1909 (DE) .
4504 5/1978 (DE) .
0706826A1 4/1996 (EP) .
415230 9/1910 (FR) .
1296235 11/1962 (FR) .

* cited by examiner

*Primary Examiner*—Allen Ostrager
*Assistant Examiner*—William Hong
(74) *Attorney, Agent, or Firm*—Wenderoth, Lind & Ponack, L.L.P.

(57) ABSTRACT

Device for milling food products, including two separate milling passages and a sifting member (18, 19) interposed between the two milling passages. The sifting member (18, 19) includes a rotating member (18) which affects the product that leaves the first milling passage so as to propel it against a screening surface (19). The apparatus uses a plurality of devices and the method uses the device.

20 Claims, 6 Drawing Sheets

MILLING DEVICE WITH DOUBLE MILLING PASSAGE, APPARATUS USING THE DEVICE, AND METHOD USING THE DEVICE

BACKGROUND OF THE INVENTION

1. Field of the Invention

The invention relates to a milling device with double milling passage, to an apparatus which uses the device, and to a method which uses the device.

More particularly, the invention relates to the milling of grain, particularly cereals and derivatives thereof, by feeding the product to be milled to two pairs of milling rollers. The amount of product fed to the rollers is determined, for example, by means of a capacitive sensor, according to Italian patent application MI 98 A 000117. The milling rollers of each pair rotate at mutually different speeds. In this manner, the different mutual speed of the two rollers which occurs in the contact region produces friction which does not simply crush the cereals but pulverizes them. In this step separation between the particles of the outer skin of the grain and the semolina also occurs. The dimensions of the particles obtained by virtue of a milling passage depend on the distance between the rollers, on the moisture, et cetera.

In order to obtain high-quality flour, as required by the market, it is necessary to adequately separate the semolina particles from the outer skin particles. The most effective method consists in sizing semolina batches and then sending them to specific machines which separate by density the pure semolina from the semolina that has not yet been cleaned and from the outer skin parts. These machines are known as plansifters. Optimum efficiency and capacity of these machines are closely linked to the particle size of the semolina to be cleaned; specifically, the larger the particle size of the semolina, the easier it is to separate the outer skin parts from the semolina and the greater the capacity of the machine.

This is the technological reason why flour producers prefer to separate by sifting, immediately after each milling passage, the semolina that has been produced, to prevent the semolina from being subjected to a particle size reduction due to another milling passage.

The plansifter, that is to say, the machine that separates the semolina particles from the outer skin particles, in fact operates according to density. Relatively small semolina particles tend to have, in the powder that forms inside the plansifter, a density which is relatively more similar to the density of the outer skin parts and therefore separation thereof is more difficult. In practice, the ascending air stream which is present in the plansifter and should stratify the particles according to density increases in effectiveness as semolina particle size increases.

In order to solve this problem, a separation stage is generally provided after each milling stage in a cereal milling apparatus. In this manner it is possible to separate the outer skin particles from the semolina particles in a timely fashion, when the semolina particles are still relatively large, before the subsequent milling.

The above is the main field of industrial application of the invention and does not constitute a limitation, since the invention can be used in equivalent fields.

2. Description of the Prior Art

It is known to use cereal roller mills which use two stacked milling passages. Each passage uses two pairs of milling rollers, so that the product is milled first by the two pairs of upper rollers and then by the two pairs of lower rollers. This system is shown for example in European patent EP 334919 in the name of Buehler. In this manner, however, the semolina particles are inevitably milled twice, reducing their dimensions to a level which, for many applications, is considered too small to allow adequate separation.

On the other hand, this solution with two stacked milling passages is useful to increase the productivity of a milling apparatus even in confined spaces, reducing costs.

It has also been noted that whenever a cereal or derivative thereof is passed through a pair of milling rollers, its volume increases, that is to say, its relative density decreases. In conventional milling with sifting after each milling passage, each successive pair of milling rollers is loaded with a smaller amount than the previous milling passage; the increase in volume is therefore compensated by a reduction in the amount of product. In the case of "stacked" milling without intermediate sifting, this balancing is not possible and it is therefore necessary to reduce the capacity of the machine. Attempts have been made to obviate the problem by increasing the rotation rate of the lower passage, but this refinement has limitations, since there are speeds which it is not convenient to exceed, otherwise milling quality worsens. In practice, therefore, a mill with double stacked passages is unable to mill the same amount of flour as a single-passage mill. If the length of the milling generatrix is equal and is approximately 1000 mm, a single-passage mill processes, if used as first break stage, an average of 8 tons per hour of soft wheat, whilst a stacked double-passage mill mills up to 6 tons per hour.

In order to overcome these problems, it has long been thought to insert in a stacked double-passage mill, an intermediate sifting system arranged between the first passage and the second passage. This solution is shown in patent GB-A-6693 dated 1908 in the name of Simon and in the French patent 415.230 of 1910; the same concept was used more recently in patent application EP 0706826 in the name of Sangati. These solutions use a sifter which generally vibrates constantly to facilitate the passage of the product through it. However, in practice it has been found that this solution has problems, since the sifter tends to clog, after which sifting efficiency drops to entirely insufficient values. Providing maintenance for manual cleaning of the sifters in not compatible with the management criteria of the apparatus, since it would be necessary to stop the machine and this, in practice, is industrially unacceptable. Therefore, according to these solutions, after prolonged operation it is not possible to satisfactorily reduce the flow of product that passes through the second milling passage.

French Patent 1 296 235 discloses an arrangement in which a single large roller is coupled with three small rollers. After each milling step there is arranged a rotating sifting step, operating by aspiration under a vacuum. This arrangement has some problems. First of all, the fact that the sifting steps operate by aspiration causes that the screening capacity of the sifting step is very low. In fact, the aspiration of the through fraction cannot be too strong, otherwise the screened fraction cannot be released, so clogging the sifting step. A weak aspiration causes an insufficient separation because the product tends to pass without being aspired. Also this arrangement involves additional working expenses for the cost of aspiration and plant expenses for the necessary connections of the device to the aspiration and separation means. Also this arrangement teaches the use of a single milling line and not of two parallel milling lines as taught for example by EP 0706826. So a single milling line involves a capacity reduced by half. This alone is a serious drawback that nullifies the scope of stacking two milling passages in series into a single device. On the other end, it is impossible to arrange two parallel lines, according to this French patent into a single machine, because the arrangement is too cumbersome. Finally, even if more than 25 years passed from the publication of this French patent, this machine did not have any appreciable industrial exploitation so showing the lack of effective usefulness.

German patent 3327 of 1877 teaches and use of two milling steps in which the separation is arranged only after both milling steps. Between the two steps there is only arranged a brush for cleaning the rollers. So the mill according to this document is afflicted by all the above considered drawbacks for the case in which two milling steps are provided without intermediate separation.

German patent 207543 of 1906 teaches a device for milling malt for the brewing industry. This is a completely different field that operates in different ways. Particularly this document discloses a wet milling, in which water is sprayed onto the rollers during milling. In the field according to the invention it is completely unacceptable to add water to the rollers of the roller mill. So the milling conditions and separation requirements are so different that no comparison is possible. The device includes a rotating member which throws the milled product against a sieving surface. The sieving surface is arranged far from the rotating member. There is nothing that prevents a rapid clogging of the sieving surface and so a prompt decrease of the separation effectiveness.

So, none of the prior art documents has been able to solve the above problems. Furthermore, the unsolved separation problems are passed on to the downstream operations, where it is necessary to separate the product which has been milled, in practice, twice in a row. In this regard it should be noted that in all the above mentioned cases the second milling passage must be substantially different from the first one to essentially avoid useless work; that is to say, the distance of the rollers must be smaller or the number of grooves on the rollers must be increased; all these refinements entail producing an increasingly finer milled product which accordingly, for the above cited reasons, is more difficult to separate.

SUMMARY OF THE INVENTION

The aim of the present invention is therefore to overcome the above drawbacks with a device for milling food products, particularly cereals, comprising two upper couples of upper milling rollers and, under them, two lower couples of lower milling rollers and two sifting members interposed between, so that the product grinded by one of said upper couples is sifted by one of said sifting members, and so that the screened fraction of said sifting member is grinded by one of said lower couples; said sifting member comprising a rotating member provided with a plurality of protruding bodies for engaging the product that leaves said upper couple, so as to propel it against a screening surface, said protruding bodies having a circular skimming motion with respect to said screening surface, in order to separate a significant amount of product.

The invention furthermore relates to a milling apparatus which includes a plurality of devices as described above.

According to another aspect of the invention, the milling apparatus according to the invention, for milling food products, particularly cereals, comprises: two upper couples of upper milling rollers and, under them, two lower couples of lower milling rollers and two sifting members interposed between, so that the product grinded by one of said upper couples is sifted by one of said sifting members, and so that the screened fraction of said sifting member is grinded by one of said lower couples; a second sifting member, provided with a second rotating member which engages the product that leaves one of said lower couples, in order to perform a second separation before the product leaves the device; the screened fraction of said second screening surface being sent to a subsequent milling without requiring further intermediate sifting, the through fraction of said second screening surface being sent to a classification unit.

The invention furthermore relates to a milling process which includes, in succession, a first milling passage, a separation passage, forming a screened fraction and a through fraction, and a second milling passage for milling said screened fraction, characterized in that the product of said second milling passage and said through fraction are combined and sent to a classification unit.

According to another aspect the invention relates to a milling method comprising, in succession, a first milling passage of cereals, a fall, by gravity, of the milled product to a sifting member, a sifting of said milled product, in which said milled product is forced to rotate and to skim against a concave screening surface, so that small semolina particles can pass through said screening surface, a fall, by gravity, of the screened fraction of said sifting member to a second milling passage, a fall, by gravity, of the through fraction of said sifting member, to bypass said second milling passage.

This system is applied to roller mills with smooth rollers which are meant to reduce semolina to flour (by drastic particle size reduction). In this case also, the separation of the small particles from the large particles produced by milling through the pair of upper rollers is necessary because the flour particles already produced by the previous passage, if sent to the lower passage together with the larger ones, produce a drastic reduction in the efficiency of the machine, not only because they overload the underlying passage, but most of all because the large particles that have not yet been milled are covered and embedded by the flour that has already been produced, reducing the effectiveness of the friction between the particle and the roller. In other words, the amount of flour that can be produced with a pair of rollers loaded with classified semolina is much greater than the amount of flour that can be produced by a pair of rollers loaded with semolina mixed with flour.

BRIEF DESCRIPTION OF THE DRAWINGS

The present invention will become apparent with reference to four embodiments of the invention, illustrated only by way of non-limitative example in the accompanying drawings, wherein.

DESCRIPTION OF THE PREFERRED EMBODIMENTS OF THE INVENTION

Figure 1:
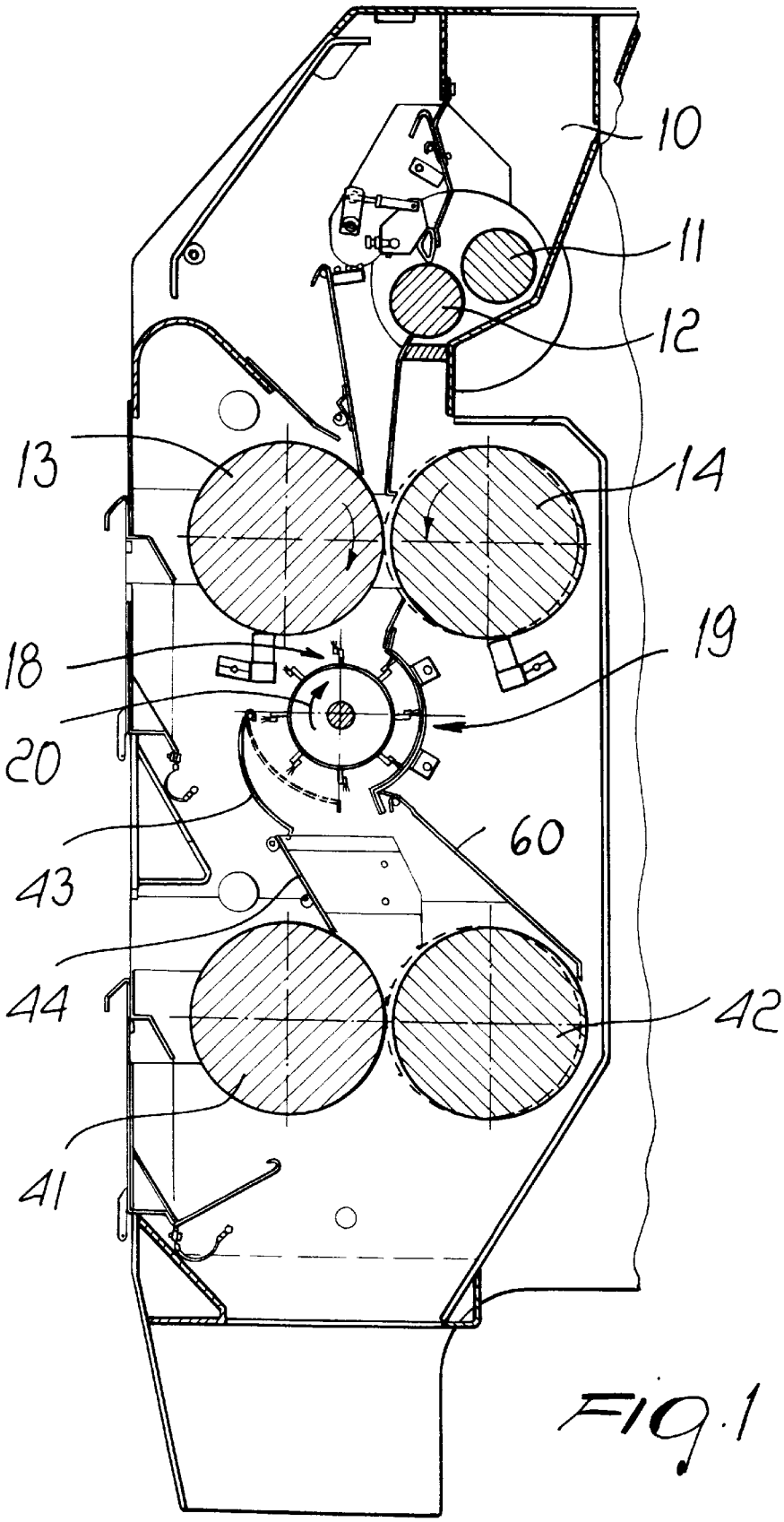
FIG. 1 is a sectional side view of the device according to the invention.
Figure 3:
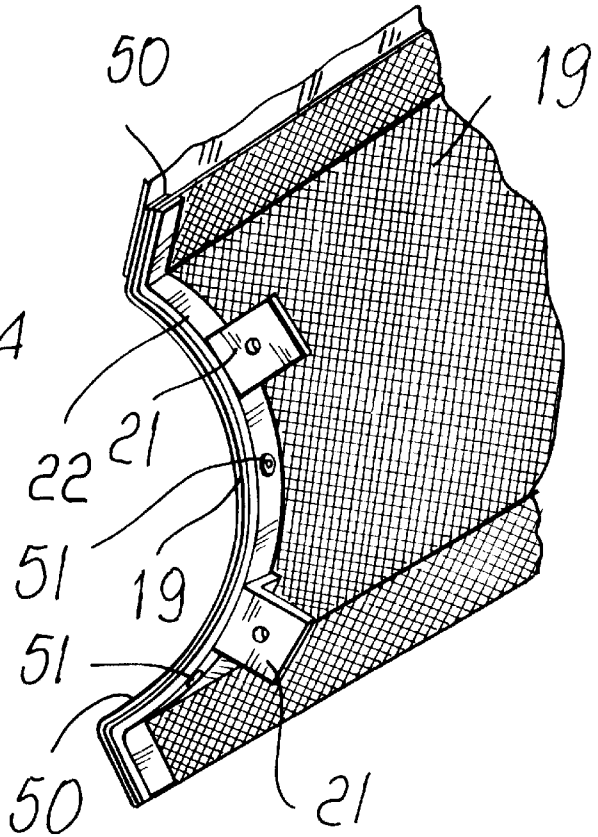
FIG. 3 is an enlarged-scale perspective view of a detail of the device of FIG. 1.
Figure 2:
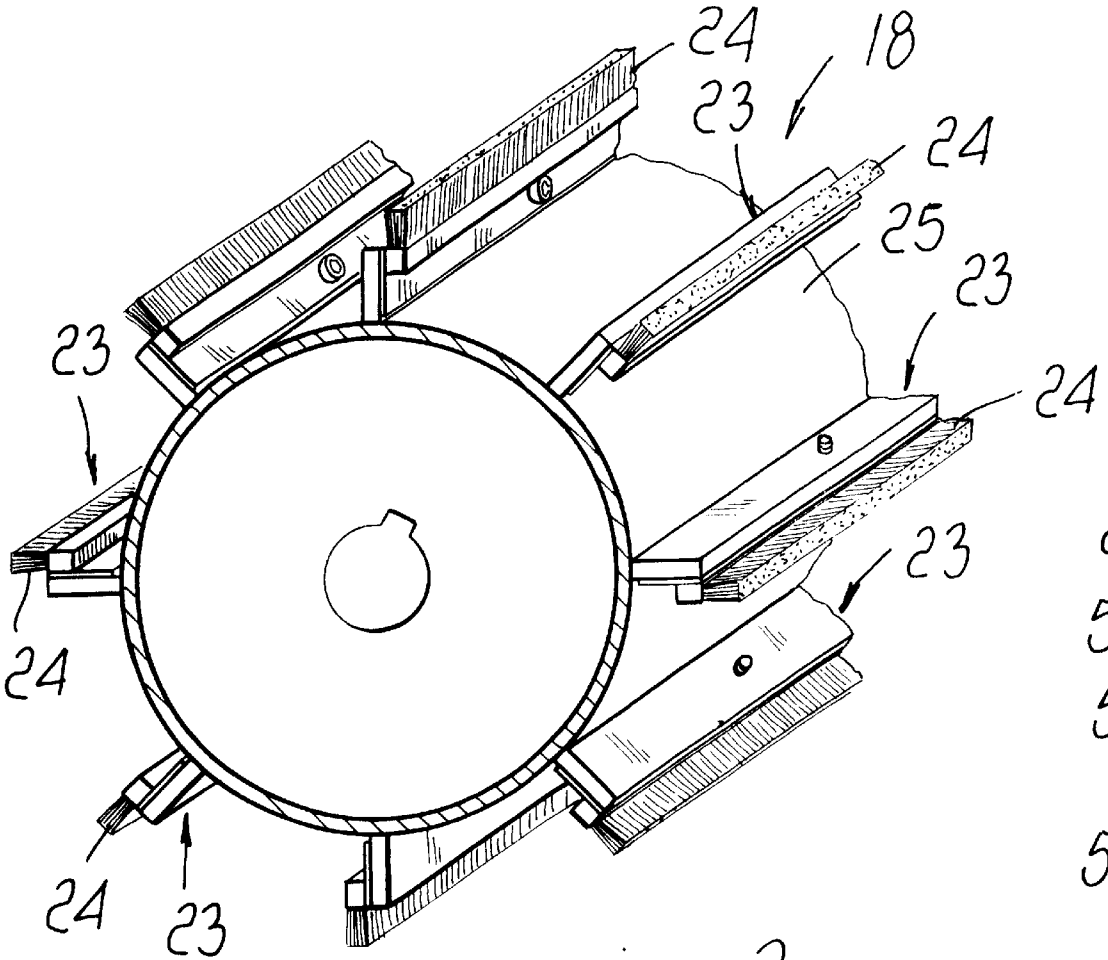
FIG. 2 is an enlarged-scale sectional perspective view of a detail of the device of FIG. 1.

With reference to FIGS. 1 to 9, and with particular reference to FIG. 1, which illustrates only half of the machine, since the other half is perfectly equivalent, the device for milling food products according to the invention includes an accumulator feeder chamber 10 which feeds two feeder rollers 11 and 12. The feeder rollers 11 and 12 are meant to distribute the product over the entire length of the rollers, so as to uniformly feed the milling rollers 13 and 14. The feeder rollers 11 and 12 themselves perform no milling action.

The rollers 13 and 14 provide the first milling passage by rotating at mutually different rates. In particular, the different rotation rate of the milling rollers is shown, with particular reference to FIG. 4, by the different diameter of the pulleys 15 and 16 which, by virtue of the belt 17, adjust the different speed of the milling rollers.

After first breaking, which is performed in the first milling passage described above, the product falls onto a rotating member 18 which engages it, so as to propel it against a screening surface 19. The rotating member 18 rotates in the direction indicated by the arrow 20.

The screening surface 19 is preferably shaped like a cylindrical sector and is generally formed by a series of sized openings formed for example with a metal mesh, so as to allow the passage of product having less than a certain preset particle size. The screening surface 19 is generally fixed at the end by virtue of the semicircular reinforcement plates 22 and 50. The three screening surface parts and the plates are joined by virtue of rivets 51. The cylindrical sector preferably covers an arc of 90 to 180°. The entire assembly is fixed to the frame of the device by virtue of the brackets 21.

The rotating member 18 includes a plurality of protruding bodies 23 which have a circular skimming motion with respect to the screening surface 19. The protruding bodies 23 are shaped like cleaning parts, so as to keep the screening surface 19 clean. Preferably, they are flexible in the end part 24, which in particular is formed by brushes.

According to a preferred embodiment of the invention, the rotating member 18 includes a cylindrical body 25 which supports the protruding bodies 23. Preferably a length of said protruding bodies 23 is shorter than a radius of said cylindrical body 25. This embodiment has the further advantage of controlling the space, and therefore the accumulation of product, between the cylindrical body 25 and the screening surface 19.

Preferably, the protruding bodies 23 trace, during rotation, a circumference which has a maximum diameter of 100 to 400 mm. Preferably, the rotating member 18 has a rotation rate of 25 to 300 rpm.

According to a preferred embodiment of the invention, the rotating member 18 has a quick coupling and release means for maintenance or replacement. In particular, the quick coupling and release means includes bearings 30 which remain rigidly coupled to the frame 31 of the device during disassembly. The quick coupling and release means furthermore includes a detachable body, which can be provided in the form of the pivot 32, with particular reference to FIG. 8, in which the lever 55 allows to insert the pivot 32, or by virtue of the pins 33 and the locking plate 34, which engage the pivots 35, with particular reference to FIGS. 6 and 7. In any case, the detachable bodies 32, 33, 34 allow to quickly free the rotating member 18, and particularly the cylinder 25, from the bearings 30, so as to allow maintenance and replacement.

Figure 4:
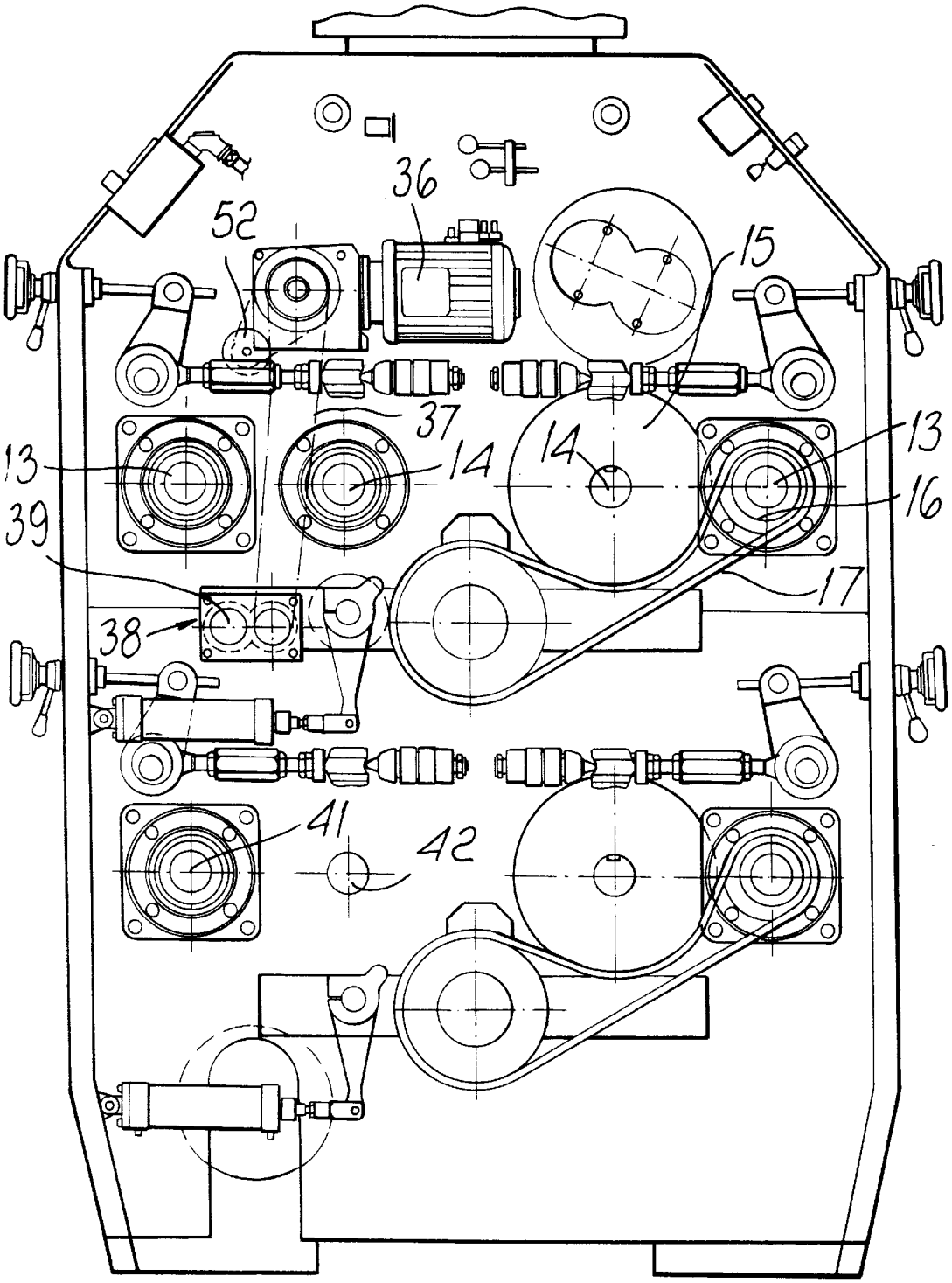
FIG. 4 is a side view of the device of FIG. 1.

According to a first embodiment, with particular reference to FIG. 4, the rotating member 18 is motorized by virtue of a motor 36 by virtue of the belt 37 and by virtue of the motion reversing unit 38; in this manner, the shaft 39, which is directly connected to the rotating member 18, is actuated in the correct direction indicated by the arrow 20.

The motor 36, which drives the rotating member 18, also drives the dosage rollers 11 and 12 for the dosage of the product to the milling rollers. The belt is tensioned by virtue of the jockey pulley 52. If there is space available, it is possible to motorize the rotating member 18 with an independent gearmotor, but the described solution is preferred because of its compactness and low cost. The rotation rate of the rotating member 18 can of course be altered by acting on the pulleys that support the belt.

Figure 9:
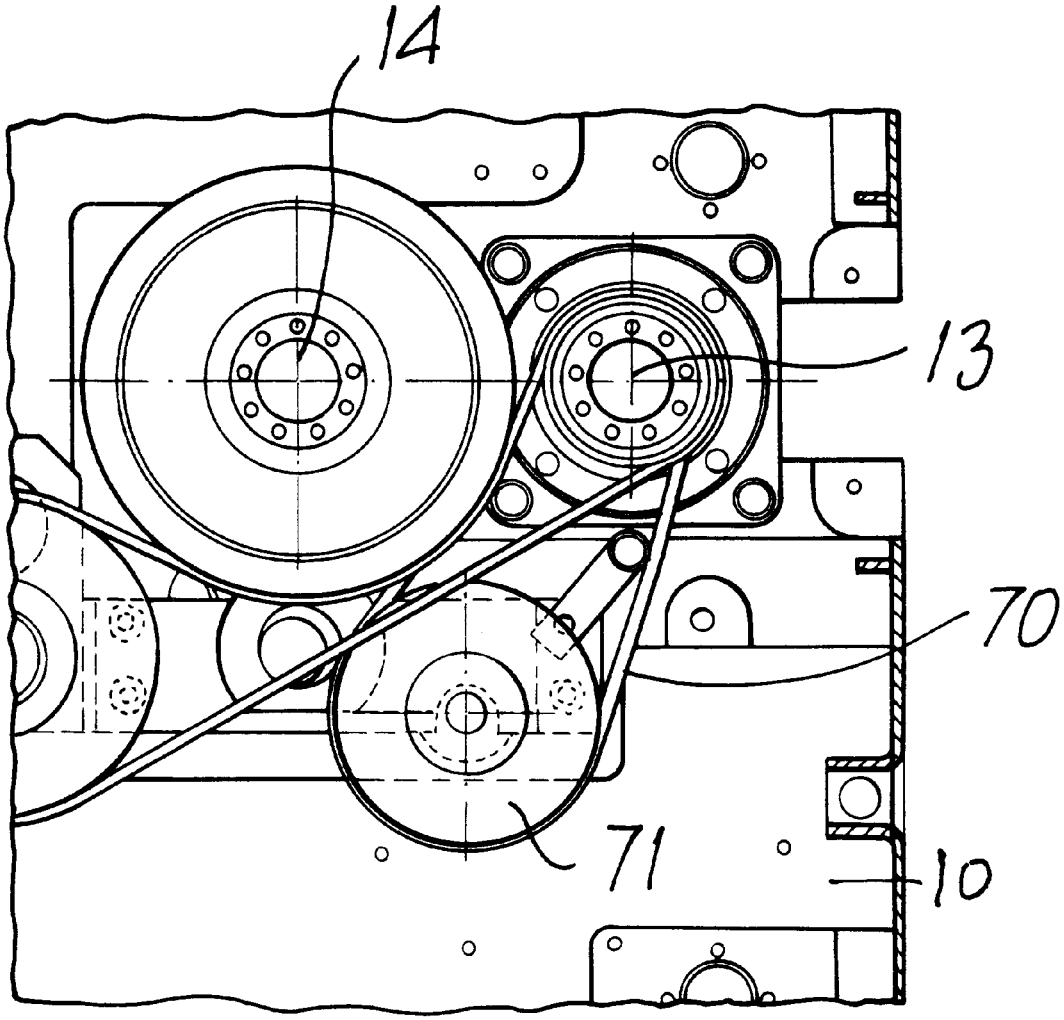
FIG. 9 is a side view of a second embodiment of the device of FIG. 4.

According to a second preferred embodiment, with particular reference to FIG. 9, the rotating member 18 is motorized by a pulley 71 that is driven by the shaft of one of the two milling rollers 13, 14, preferably by the shaft of the roller 13 that rotates faster. This second embodiment is preferred, since it is simpler, less expensive and does not require a motion inverter.

In this manner, the action of the cleaning parts 24, combined with the percentage of open area in the screening surface 19, allows to separate the stream of product into a through fraction and a screened fraction. The through fraction slides on the plate 60 and bypasses the subsequent milling passage. This subsequent milling passage or second milling passage is provided by the rollers 41 and 42, which are motorized like the rollers of the first milling passage.

The fraction rejected by the screening surface 19 falls onto the oscillating plate 43, which has two positions: an active position, shown in solid lines in the drawings, and an inspection position, for checking the particle size of the product or for other inspections, which is shown in dashed lines in the drawings.

By virtue of the oscillating plate 43 and then the fixed plate 44, the product reaches the second milling passage of the rollers 41 and 42.

The two fractions, namely the through fraction generated by passing through the screening surface 19 and the milled fraction produced by the second milling passage, can remain separate or be combined. Preferably, they are combined and sent to a plansifter.

Figure 5:
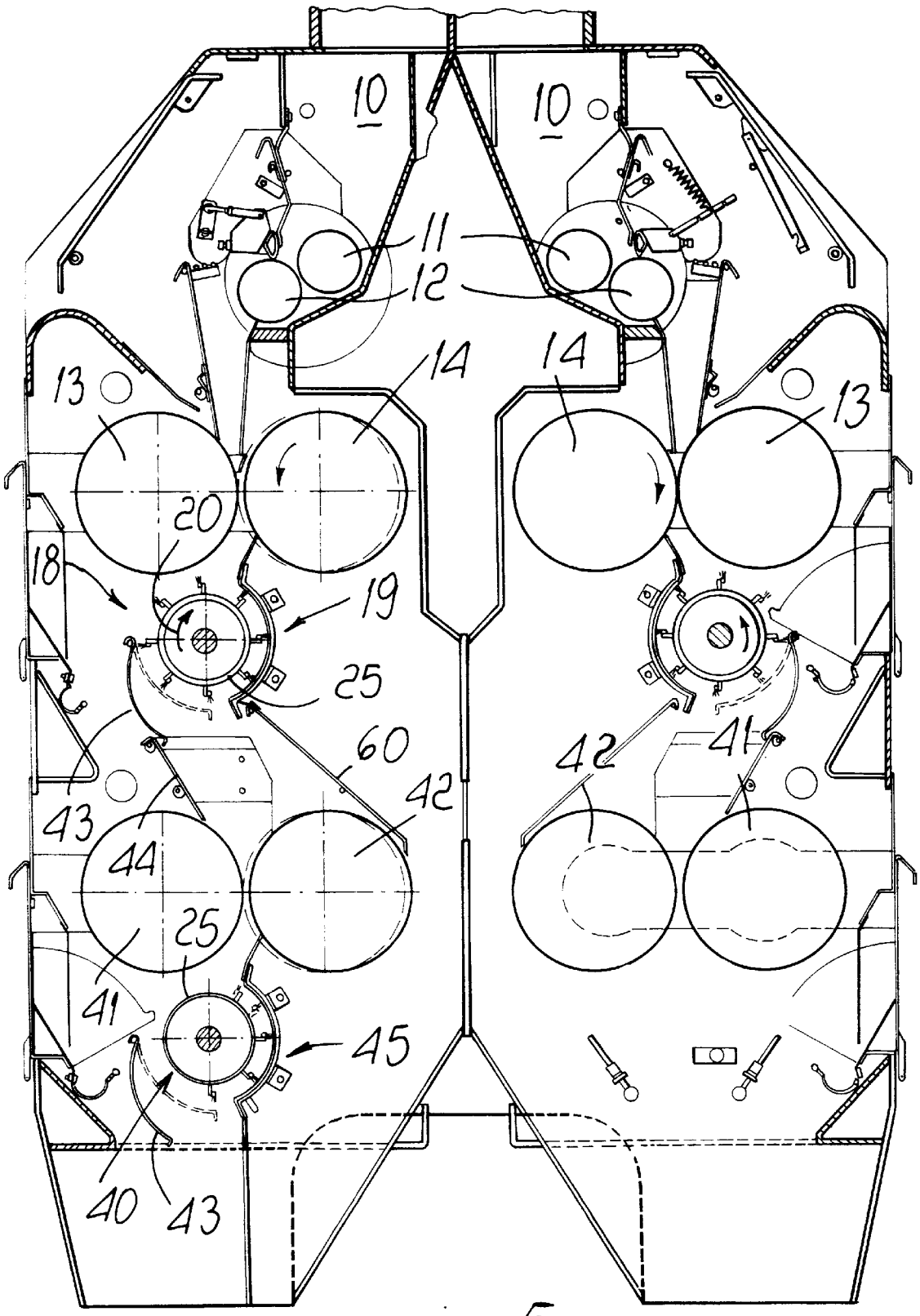
FIG. 5 is a sectional side view of a second embodiment of the device according to the invention.
Figure 6:
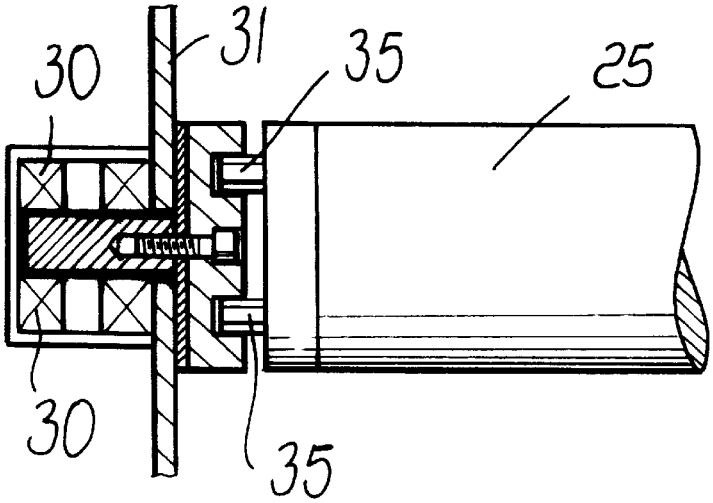
FIG. 6 is a partially sectional front view of a detail of the device of FIG. 1.
Figure 7:
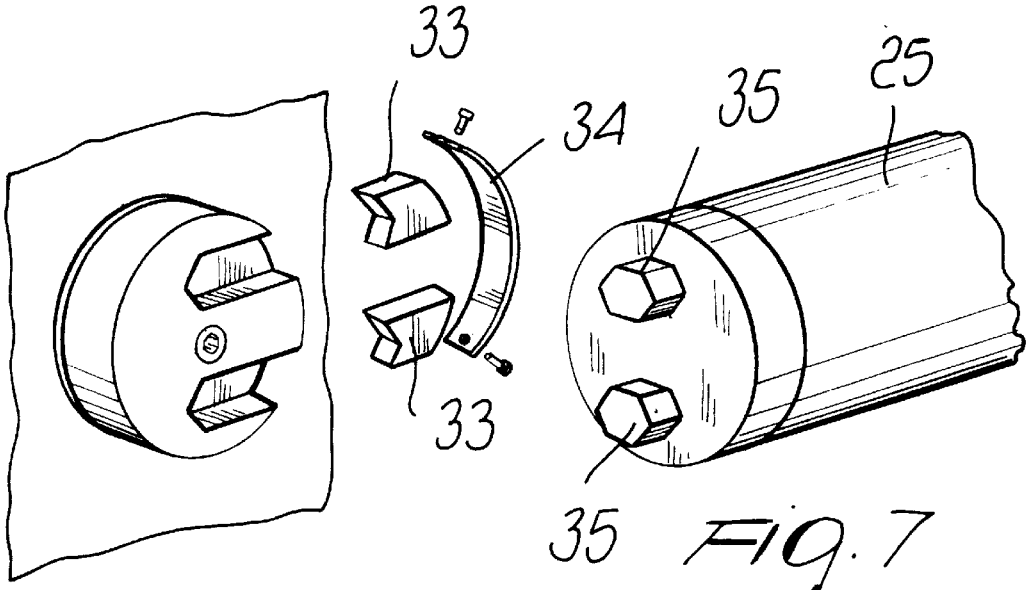
FIG. 7 is an exploded perspective view of the detail of FIG. 6.
Figure 8:
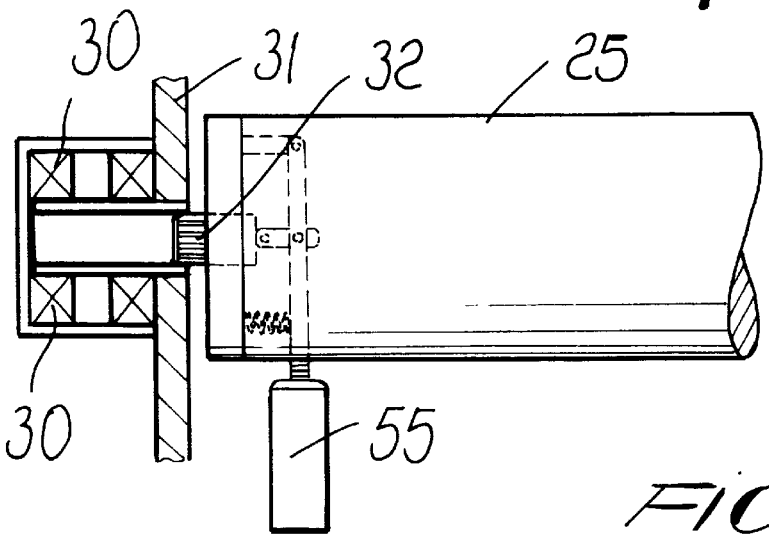
FIG. 8 is a partially sectional front view of a third embodiment of the device according to the invention.

According to another embodiment of the invention, shown with particular reference to FIG. 5, there is a second rotating member 40 which engages the product that leaves the second milling passage of the rollers 41 and 42 so as to propel the product against a second screening surface 45, so as to perform a second separation before the product leaves the device.

The second rotating member 40 and the second screening surface 45 are shaped as described above with reference to the rotating member 18 and the screening surface 19.

The invention allows to achieve the aim and all of the intended objects, since it is possible to benefit from the advantages provided by a roller mill with a double passage of overlapping rollers without having its drawbacks. In practice, the efficiency of the coupling between the rotating member 18 and the screening surface 19 allows high separation efficiency and most of all automatic cleaning of the screening surface, so that the high separation efficiency can be maintained over time without requiring any manual intervention by the operators of the apparatus.

An important increase in capacity has also been found which is due to the smaller load of product fed to the second milling passage. All the product that passes through the screening surface 19 is of course not sent to the second milling passage, so that the passage, which constitutes so to speak the bottleneck of the apparatus, due to the limited distance between the milling rollers, is not loaded with the additional amount of separated product as well.

It is thus also possible to reduce the electric power absorbed for the second milling passage and reduce the overall space occupation of the apparatus.

Of course, there is still also the important reduction in machine costs with respect to two conventional separate machines in which each one provides a single roller milling passage.

Finally, a reduction in the cost of the total sifting surface has also been noted, since the effectiveness of the work performed by the rotating member 18 and by the screening surface 19 allows to save significantly on the size of the screening surfaces that are normally used downstream of roller mills.

If a single rotating member 18 and a single screening surface 19 are used, as shown with particular reference to FIG. 1, and more specifically in case of use with smooth milling rollers, that is to say, for the final steps of milling, the through fraction and the screened fraction can be recombined, after the second milling passage, with a solution which is very simple but nonetheless allows to considerably increase the efficiency of the machine.

If a double screening system is used instead, as shown with particular reference to FIG. 5, the screened fraction of the screening surface 45 is sent directly to a subsequent milling without requiring classification on a plansifter. This clearly entails not only an increase in capacity, as in the previous case, but also a significant saving in the cost of the plansifter. The through fraction, which passes through the screening surface 45, is instead sent of course to a classification unit (plansifter) as usual, but in this case the unit is smaller. This solution is particularly interesting in case of so-called "breaking in", that is to say, during the initial steps of the milling of the unrefined cereal.

It has also been found, surprisingly, that the invention allows to separate a part of product which can vary between 14 and 50% by weight, according to the milling passage, of the flow-rate at the input of the machine.

As a first example, when the device according to the invention is used in a typical so called "break" milling passage, i.e. using fluted rolls, diameter 250 mm, lenght 1000 mm, it allows to separate up to 15.7% of the product; such separation may be obtained when the rotating member 18 rotates at 250 rpm and is coupled with a screening surface 19 with slots having openings of 1.5×25 mm.

As a second example, when the device according to the invention is used in a typical so called "reduction" milling passage, i.e. using smooth rolls, diameter 250 mm, lenght 1000 mm, it allows to separate up to 43.1% of the product; such separation may be obtained when the rotating member 18 rotates at 250 rpm and is coupled with a screening surface 19 with a wire sieve, having a wire diameter of 0.7 mm and hole size of 0.69 mm.

What is claimed is:

1. A device for milling cereals, said device comprising:

an upper pair of milling rollers;

a lower pair of milling rollers disposed below said upper milling rollers;

a sifting mechanism disposed between said upper milling rollers and said lower milling rollers such that the cereal ground by said upper milling rollers is sifted by said sifting mechanism, wherein a portion of the cereal sifted by said sifting mechanism is ground by said lower milling rollers, said sifting mechanism comprising a screening surface and a rotating member provided with a plurality of radially protruding bodies for engaging the cereal ground by said upper milling rollers and propelling the cereal against said screening surface, wherein, upon rotation of said rotating member, said radially protruding bodies move in a circular motion and contact said screening surface so as to perform a skimming operation in order to separate the cereal into a portion that passes through said screening surface and a screened portion that does not pass through said screening surface.

2. A device as claimed in claim 1, further comprising:

a second upper pair of milling rollers;

a second lower pair of milling rollers disposed below said second pair of upper milling rollers;

a second sifting mechanism disposed between said second pair of upper milling rollers and said second pair of lower milling rollers such that the cereal ground by said second pair of upper milling rollers is sifted by said second sifting mechanism, wherein a portion of the cereal sifted by said second sifting mechanism is ground by said second pair of lower milling rollers, said second sifting mechanism comprising a screening surface and a rotating member provided with a plurality of radially protruding bodies for engaging the cereal ground by said second pair of upper milling rollers and propelling the cereal against said screening surface, wherein, upon rotation of said rotating member of said second sifting mechanism, said radially protruding bodies move in a circular motion and contact said screening surface so as to perform a skimming operation in order to separate the cereal into a portion that passes through said screening surface and a screened portion that does not pass through said screening surface.

3. A device as claimed in claim 1, wherein each of said protruding bodies comprises a radial vane that terminates in a flexible portion, wherein said flexible portion is positioned to engage and clean said screening surface upon rotation of said rotating member.

4. A device as claimed in claim 1, wherein each of said flexible portions comprises an elongated brush.

5. A device as claimed in claim 1, wherein said rotating member comprises a cylindrical body that supports said protruding bodies, and a radial length of each of said protruding bodies is less than a radius of said cylindrical body.

6. A device as claimed in claim 1, wherein, upon rotation of said rotating member, said protruding bodies trace a circle having a maximum diameter between 100 mm and 400 mm.

7. A device as claimed in claim 1, wherein said rotating member is adapted to rotate at a rate of 25 to 300 rpm.

8. A device as claimed in claim 1, wherein said rotating member includes a quick release coupling means.

9. A device as claimed in claim 8, wherein said quick release coupling means comprises bearings that are rigidly attached to a frame of the device and a detachable body that permits said rotating member to be released from said bearings.

10. A device as claimed in claim 1, further comprising:

a pair of dosing rollers for dosing the product to said milling rollers; and a motor for driving said rotating member and said dosing rollers.

11. A device as claimed in claim 1, wherein said screening surface is shaped in the form of a cylindrical sector.

12. A device as claimed in claim 11, wherein said cylindrical sector extends through an arc of 90 to 180 degrees.

13. A device as claimed in claim 1, wherein said sifting mechanism is positioned relative to said upper milling rollers so as to be capable of receiving cereal from said upper milling rollers by gravity.

14. A device as claimed in claim 1, wherein said lower milling rollers are positioned relative to said sifting mechanism so that the screened portion falls by gravity from said sifting mechanism to said lower milling rollers.

15. A device as claimed in claim 14, wherein said screening surface of said sifting mechanism is positioned laterally relative to a vertical flow direction of the screened portion falling from said lower milling rollers.

16. A device as claimed in claim 1, further comprising a second sifting mechanism having a second rotating member for engaging the cereal from said lower milling rollers and rotating relative to second screening surface, wherein said second rotating member is operable to propel the cereal against said second screening surface in order to perform a second separating operation before the cereal leaves the device.

17. A device as claimed in claim 16, wherein said second rotating member comprises a cylindrical body that supports said protruding bodies, and said second screening surface is shaped in the form of a cylindrical sector.

18. A device as claimed in claim 16, wherein said second sifting member is positioned relative to said lower milling rollers so as to be capable of receiving cereal from said upper milling rollers by gravity.

19. A device as claimed in claim 1, wherein said rotating member is driven by a pulley that is driven by a shaft of one of said upper milling rollers.

20. A milling apparatus as claimed in claim 1, further comprising:

an oscillating plate positioned adjacent said rotating member, said oscillating plate being movable between an active position and an inspection position; and a fixed plate disposed below said oscillating plate, wherein the screened portion of the cereal from said first sifting device is guided by said oscillating plate and said fixed plate into a second milling passage defined by said lower milling rollers.

* * * * *

UNITED STATES PATENT AND TRADEMARK OFFICE

CERTIFICATE OF CORRECTION

PATENT NO. : 6,293,478 B1
DATED : September 25, 2001
INVENTOR(S) : Filipppo Livrieri It is certified that error appears in the above-identified patent and that said Letters Patent is hereby corrected as shown below:

Claim 4,
Line 1, change "claim 1" to -- claim 3 --.

Signed and Sealed this

Fourteenth Day of May, 2002

*Attest:*

*Attesting Officer*

JAMES E. ROGAN
*Director of the United States Patent and Trademark Office*